US005795053A

United States Patent [19]

Pierce

[11] Patent Number: 5,795,053

[45] Date of Patent: Aug. 18, 1998

[54] ILLUMINATED FIRE HOSE RESCUE NOZZLE

[76] Inventor: Adam Benson Pierce, 44 Arrandale Ave., Great Neck, N.Y. 11024

[21] Appl. No.: 762,281

[22] Filed: Dec. 9, 1996

[51] Int. Cl.[6] ..... F21V 33/00

[52] U.S. Cl. ..... 362/96; 362/191; 362/194; 362/253

[58] Field of Search ..... 362/96, 190, 191, 362/194, 195, 198, 199, 103, 108, 253

[56] References Cited

U.S. PATENT DOCUMENTS

| | | | |
|---|---|---|---|
| 1,623,002 | 3/1927 | Gossett | 362/103 |
| 1,662,668 | 3/1928 | Gossett | 362/103 |
| 4,262,324 | 4/1981 | Murphy | 362/108 |
| 4,794,496 | 12/1988 | Lanes et al. | 362/108 |
| 5,239,451 | 8/1993 | Menke et al. | 362/199 |
| 5,544,026 | 8/1996 | Holbrook | 362/103 |

*Primary Examiner*—Alan Cariaso

[57] ABSTRACT

A new Illuminated Fire Hose Rescue Nozzle for offering a portable, optional light for a fire hose nozzle that illuminates a target or a pathway. The inventive device includes a light, a mounting means, and a power means. In use, the device is attached to a nozzle 4 of a fire hose 2 and when the on-off switch 14 is used to energize light 12, a pathway is illuminated in the direction the fire hose 2 is pointed.

11 Claims, 4 Drawing Sheets

14

50
12
16
26
20
24
22
5
5
30
36
32
34

22
38

ILLUMINATED FIRE HOSE RESCUE NOZZLE

BACKGROUND OF THE INVENTION

1. Field of the Invention

The present invention relates to fire fighting equipment and more particularly pertains to a new Illuminated Fire Hose Rescue Nozzle for offering a portable, optional light for a fire hose nozzle that illuminates a target or a pathway.

2. Description of the Prior Art

The use of fire fighting equipment is known in the prior art. More specifically, fire fighting equipment heretofore devised and utilized are known to consist basically of familiar, expected and obvious structural configurations, notwithstanding the myriad of designs encompassed by the crowded prior art which have been developed for the fulfillment of countless objectives and requirements.

Known prior art fire fighting equipment include U.S. Pat. No. 4,220,304; U.S. Pat. No. 5,181,774; U.S. Pat. No. Des. 321,765; U.S. Pat. No. 5,440,462; U.S. Pat. No. 5,383,633; and U.S. Pat. No. 5,438,494.

While these devices fulfill their respective, particular objectives and requirements, the aforementioned patents do not disclose a new Illuminated Fire Hose Rescue Nozzle. The problem with prior devises such as helmet lights is that they are blocked out by smoke. The most important time in fighting a fire is the first five minutes after the fire fighter has arrived at the scene. Smoke rises to approximately three to five feet off the ground or floor. The first man in has the fire hose and nozzle, ready to spray water when ever and where ever necessary. It takes both of his hands to hold and operate the hose and nozzle. His helmet light is almost always blocked out by the smoke and while this light is very useful, it is ineffective in locating victims that are possibly hidden under things such as beds. The inventive device includes a light, a mounting means, and a power means and does not require additional hands to operate because the device is either integrally included in the nozzle or it is fastened onto the nozzle.

In these respects, the Illuminated Fire Hose Rescue Nozzle according to the present invention substantially departs from the conventional concepts and designs of the prior art, and in so doing provides an apparatus primarily developed for the purpose of offering a portable, optional light for a fire hose nozzle that illuminates a target or a pathway.

SUMMARY OF THE INVENTION

In view of the foregoing disadvantages inherent in the known types of fire fighting equipment now present in the prior art, the present invention provides a new Illuminated Fire Hose Rescue Nozzle construction wherein the same can be utilized for offering a portable, optional light for a fire hose nozzle that illuminates a target or a pathway.

The general purpose of the present invention, which will be described subsequently in greater detail, is to provide a new Illuminated Fire Hose Rescue Nozzle apparatus and method which has many of the advantages of the fire fighting equipment mentioned heretofore and many novel features that result in a new Illuminated Fire Hose Rescue Nozzle which is not anticipated, rendered obvious, suggested, or even implied by any of the prior art fire fighting equipment, either alone or in any combination thereof.

To attain this, the present invention generally comprises a light, a mounting means, and a power means.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Illuminated Fire Hose Rescue Nozzle apparatus and method which has many of the advantages of the fire fighting equipment mentioned heretofore and many novel features that result in a new Illuminated Fire Hose Rescue Nozzle which is not anticipated, rendered obvious, suggested, or even implied by any of the prior art fire fighting equipment, either alone or in any combination thereof.

It is another object of the present invention to provide a new Illuminated Fire Hose Rescue Nozzle which may be easily and efficiently manufactured and marketed.

It is a further object of the present invention to provide a new Illuminated Fire Hose Rescue Nozzle which is of a durable and reliable construction.

An even further object of the present invention is to provide a new Illuminated Fire Hose Rescue Nozzle which is susceptible of a low cost of manufacture with regard to both materials and labor, and which accordingly is then susceptible of low prices of sale to the consuming public, thereby making such Illuminated Fire Hose Rescue Nozzle economically available to the buying public.

Still yet another object of the present invention is to provide a new Illuminated Fire Hose Rescue Nozzle which provides in the apparatuses and methods of the prior art some of the advantages thereof, while simultaneously overcoming some of the disadvantages normally associated therewith.

Still another object of the present invention is to provide a new Illuminated Fire Hose Rescue Nozzle for offering a portable, optional light for a fire hose nozzle that illuminates a target or a pathway.

Yet another object of the present invention is to provide a new Illuminated Fire Hose Rescue Nozzle which includes a light, a mounting means, and a power means.

Still yet another object of the present invention is to provide a new Illuminated Fire Hose Rescue Nozzle that allows a fire fighter to see in the direction that the hose nozzle is pointed and illuminates some objects that a helmet light is ineffective in illuminating while the helmet light is useful in seeing other objects.

Even still another object of the present invention is to provide a new Illuminated Fire Hose Rescue Nozzle that it fits onto any size fire hose nozzle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
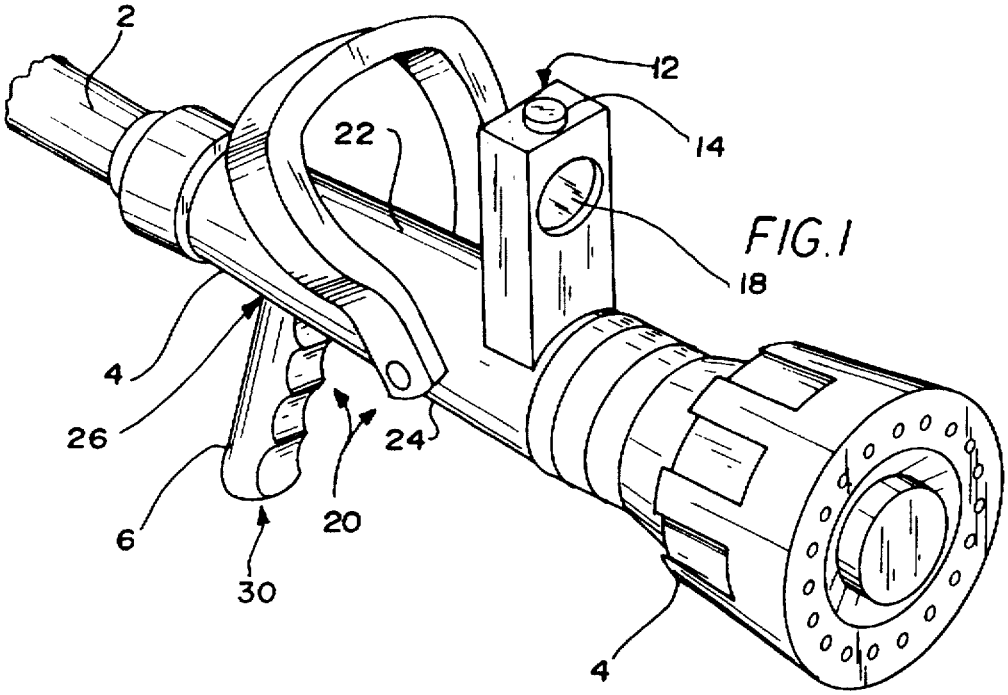
FIG. 1 is a perspective view of a new Illuminated Fire Hose Rescue Nozzle according to the present invention.

With reference now to the drawings, and in particular to FIGS. 1 through 8 thereof, a new Illuminated Fire Hose Rescue Nozzle embodying the principles and concepts of the present invention and generally designated by the reference numeral 10 will be described.

More specifically, it will be noted that the Illuminated Fire Hose Rescue Nozzle 10 comprises a light 12, a mounting means 20, and a power means 30 where the mounting means 20 is fixedly attached to the power means 30 and to the light 12 and where the mounting means 20 additionally electrically connects the power means 30 to the light 12.

As best illustrated in FIG. 1 it can be shown that the light 12 is further comprised of a bulb 13, an on-off switch 14, a light reflection means 15, and a lens 18 where the bulb 13 is electrically connected to the on-off switch 14 which in turn is electrically connected to the power means 30 and where the light reflection means 15 is fixedly fastened to the bulb 13 and is positioned to direct emitted light in one general direction through the lens 18 and where the lens 18 is further defined as a protective transparent barrier which protects the bulb 13.

Figure 7:
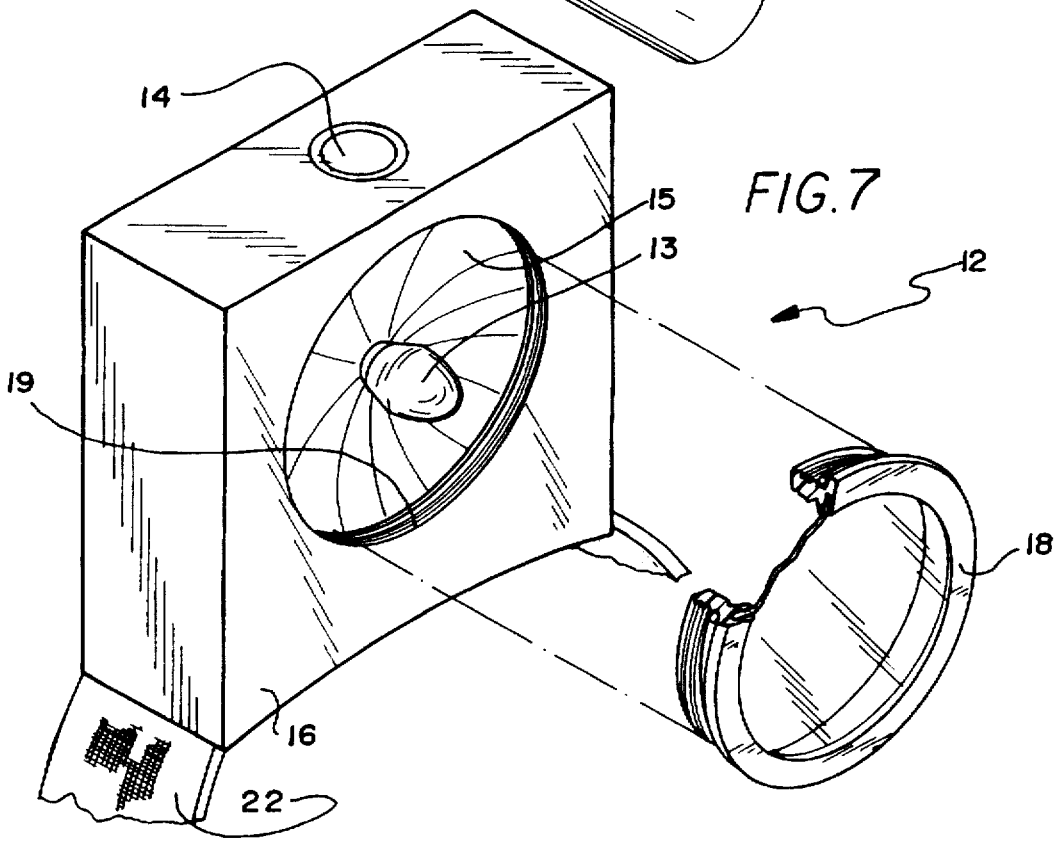
FIG. 7 is an enlarged perspective view of a light of a new Illuminated Fire Hose Rescue Nozzle.

Referring to FIG. 7, the light 12 further includes a light housing 16 which is defined as an upright elongated cube having a lens aperture 19 which threadedly receives the light reflection means 15 and the lens 18 and where the light 12 is fixedly attached to and electrically connected to the mounting means 20.

The mounting means 20 is further comprised of a band 22 which is further defined as an elongated flexible strip of chemical and weather durable material having a first attachment means 24 and a second attachment means 26 integrally included within the band 22 and where the band 22 further includes a power transfer means 38 which is fixedly and integratedly included within the band 22 and where the power transfer means 38 and the band 22 are fixedly attached and electrically connected to the power means 30 and the light 12.

The power means 30 is comprised of a handle grip 6 where the handle grip 6 matingly receives at least one battery 31 which is electrically connected to the power transfer means 38.

The handle grip 6 is further defined as an elongated cylindrical shell which protrudes into a body of the band 22.

The power transfer means 38 is further defined as at least one electrically conductive wire which, in an optional embodiment, has a length which is sufficient to allow a range of housing locations while maintaining electrical connection with the battery 31 and the light 12.

The power transfer means 38 is also defined as being comprised of a two wire electrical conductor where one wire is electrically negative and the other wire is electrically positive.

The power transfer means 38 having at least one electrically conductive wire uses a nozzle 4 of a fire hose 2 to conduct electrically negative current and where the at least one electrically conductive wire conducts electrically positive current.

In use, the device is attached to a nozzle 4 of a fire hose 2 and when the on-off switch 14 is used to energize light 12, a pathway is illuminated in the direction the fire hose 2 is pointed. When entering the scene, the firefighter holds the fire hose below a smoke plane 40 and shines the light around to locate victims which might be hiding in such areas as under beds and so forth.

Additionally, it will be noted that a basic add on alternate embodiment of the Illuminated Fire Hose Rescue Nozzle 50 comprises a light 12, a mounting means 20, and a power means 30 where the mounting means 20 is fixedly attached to the power means 30 and to the light 12 and where the mounting means 20 additionally electrically connects the power means 30 to the light 12.

As best illustrated in FIGS. 3 through 7, it can be shown that the light 12 is further comprised of a bulb 13, an on-off switch 14, a light reflection means 15, and a lens 18 where the bulb 13 is electrically connected to the on-off switch 14 which in turn is electrically connected to the power means 30 and where the light reflection means 15 is fixedly fastened to the bulb 13 and is positioned to direct emitted light in one general direction through the lens 18 and where the lens 18 is further defined as a protective transparent barrier which protects the bulb 13.

Figure 6:
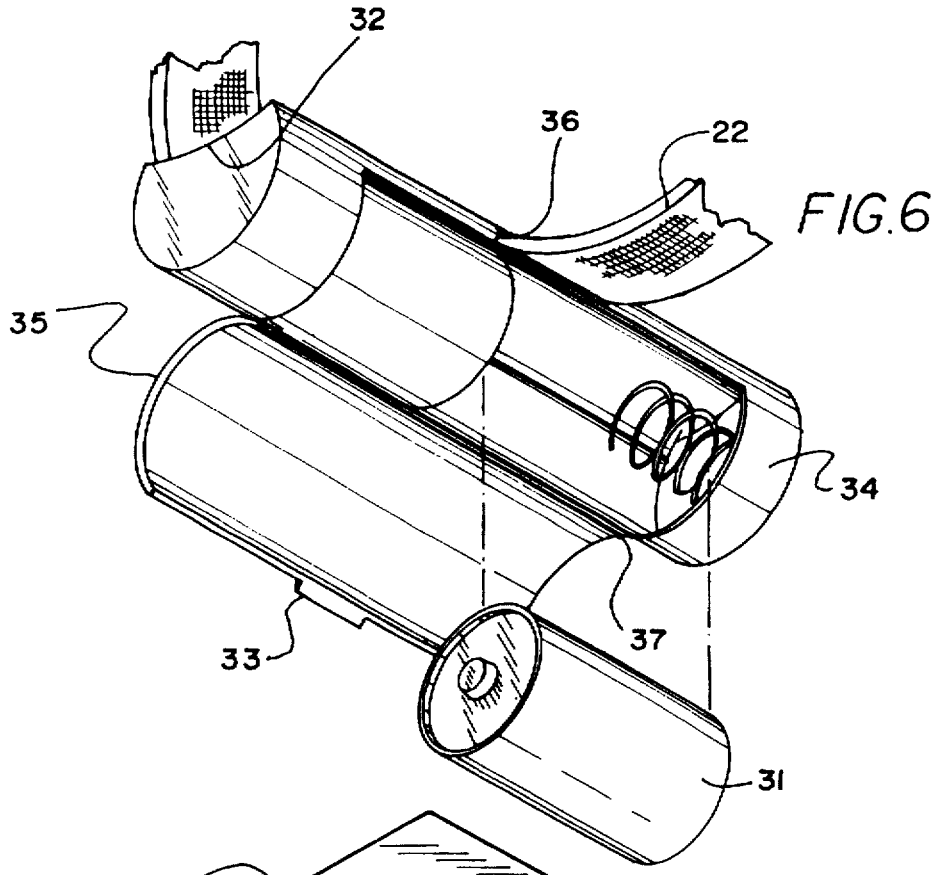
FIG. 6 is an enlarged perspective view of a power means of a new Illuminated Fire Hose Rescue Nozzle.

Referring to FIG. 6, the light 12 further includes a light housing 16 which is defined as an upright elongated cube having a lens aperture 19 which threadedly receives the light reflection means 15 and the lens 18 and where the light 12 is fixedly attached to and electrically connected to the mounting means 20.

The mounting means 20 is further comprised of a band 22 which is further defined as an elongated flexible strip of chemical and weather durable material having a first attachment means 24 and a second attachment means 26 disposed at each end of the band 22 and where the first attachment means 24 removably and matingly attaches to the second attachment means 26 and where the band 22 further includes a power transfer means 38 which is fixedly and integratedly attached to the band 22 and where the power transfer means 38 and the band 22 are fixedly attached and electrically connected to the power means 30 and the light 12.

The power means 30 is comprised of a housing 34 where the housing 34 matingly receives at least one battery 31 which is electrically connected to the power transfer means 38.

The housing 34 is further defined as an elongated cylindrical shell which further includes an arcuate mounting surface 32, and an arcuate cover 35 where the arcuate mounting surface 32 is further defined as having a curve which protrudes into a body of the housing 34 and is therefore a reverse or opposing curve to the curvature of the body of the housing 34 and where the arcuate cover 35 is pivotally attached to the housing 34 by a cover hinge 37.

The arcuate cover 35 further includes a cover latch 33 which retains the arcuate cover 35 in a closed position and where the cover latch 33 can be operated to open the arcuate cover 35 in order to access the battery 31.

The housing 34 further includes a band aperture 36 which matingly receives the band 22 and allows the band 22 to protrude through the housing 34 and also therefore allows the power transfer means 38 to be electrically connected to the battery 31.

Furthermore, the band aperture 36 can slidingly receive the band 22 and allow the housing 34 to be located any where along a middle section of the band 22 where the power transfer means 38 can accommodate a range of locations of said housing 34 along said band 22 while maintaining electrical connection with the battery 31.

The power transfer means 38 is further defined as at least one electrically conductive wire which, in an optional embodiment, has a length which is sufficient to allow a range of housing locations while maintaining electrical connection with the battery 31 and the light 12.

The power transfer means 38 is also defined as being comprised of a two wire electrical conductor where one wire is electrically negative and the other wire is electrically positive.

The power transfer means 38 having at least one electrically conductive wire uses a nozzle 4 of a fire hose 2 to conduct electrically negative current and where the at least one electrically conductive wire conducts electrically positive current.

Figure 8:
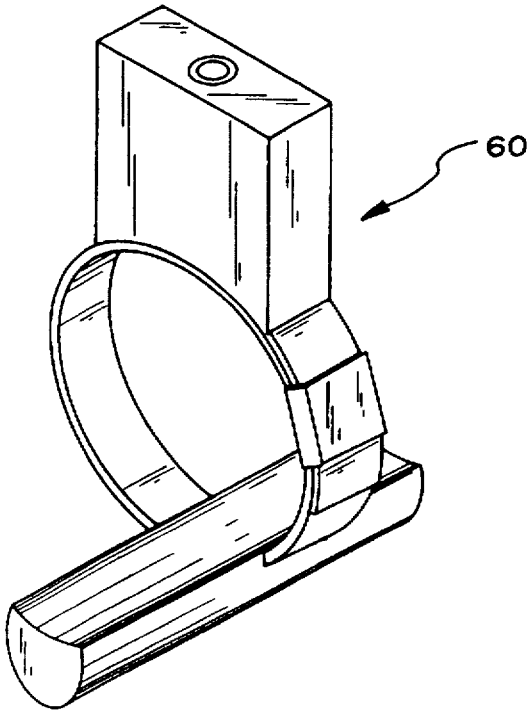
FIG. 8 is an enlarged perspective view of a preferred alternate add on embodiment of a new Illuminated Fire Hose Rescue Nozzle according to the present invention.
Figure 2:
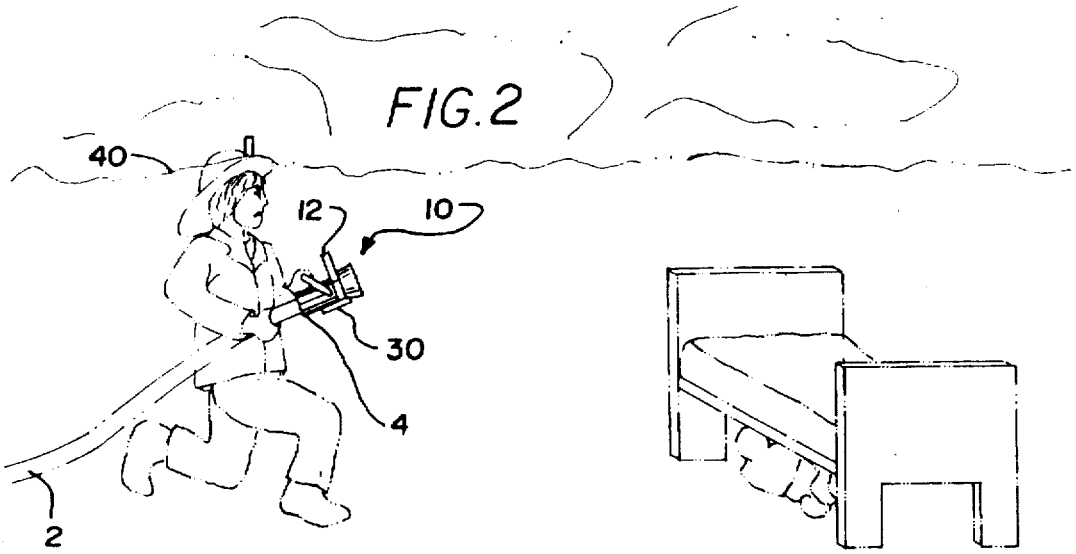
FIG. 2 is a perspective view of a new Illuminated Fire Hose Rescue Nozzle in use according to the present invention.
Figure 3:
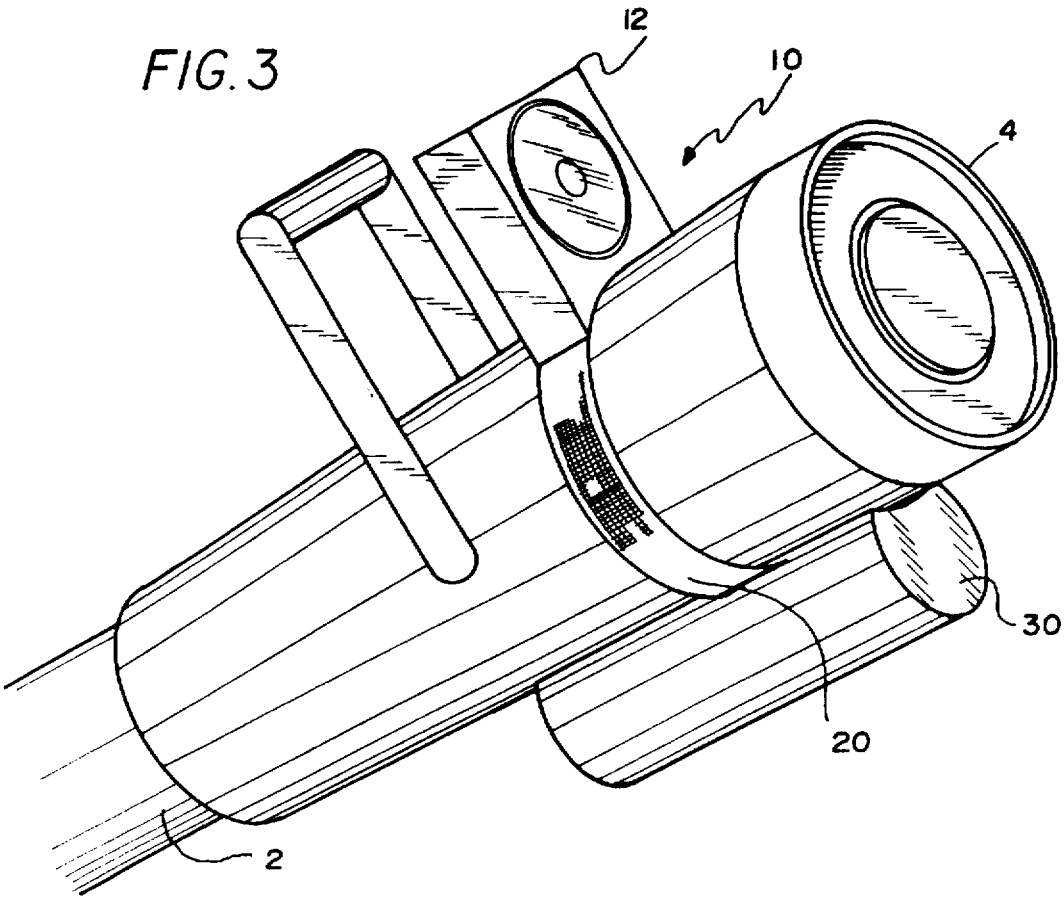
FIG. 3 is an enlarged perspective view of a new Illuminated Fire Hose Rescue Nozzle installed according to the present invention.
Figure 4:
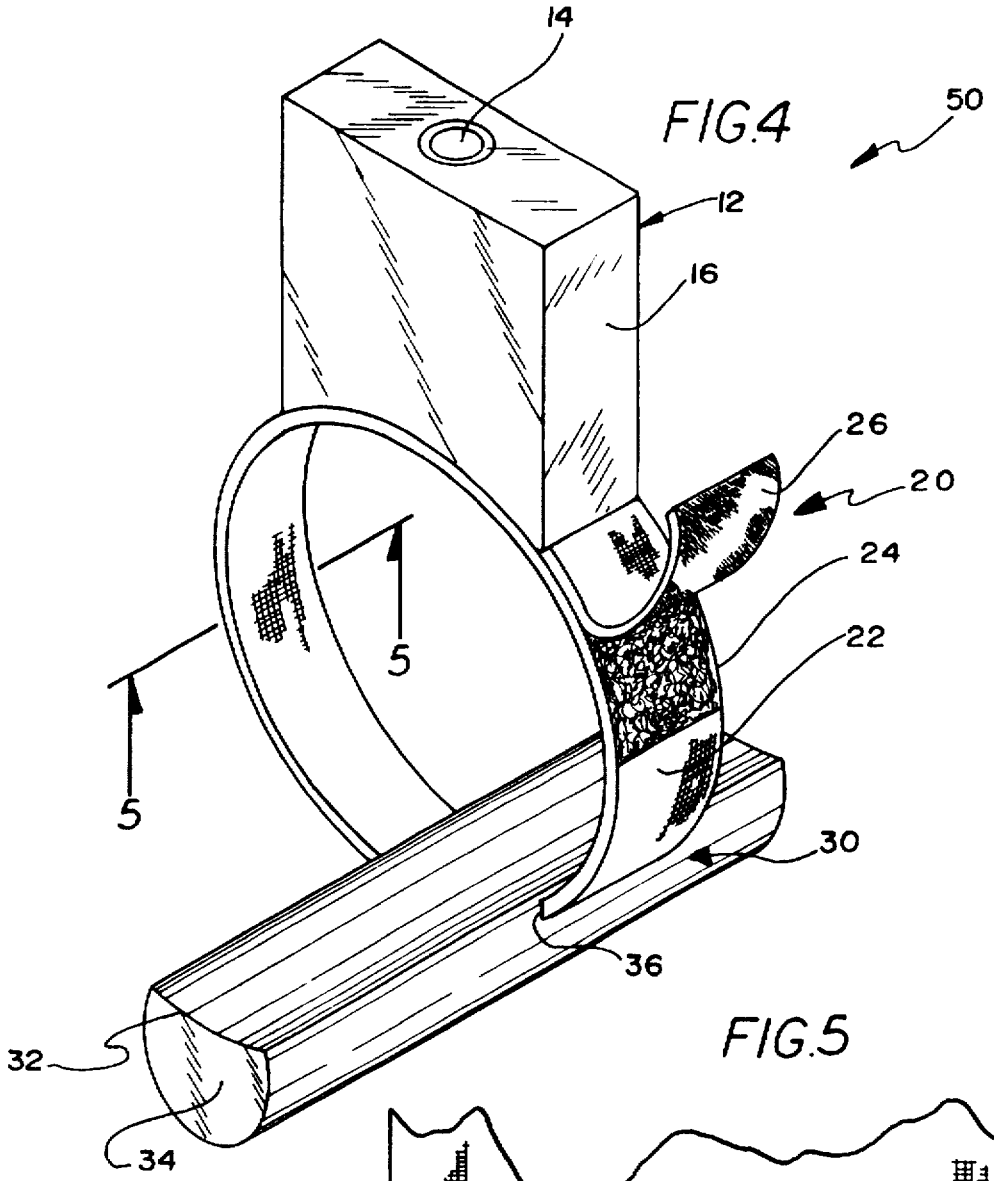
FIG. 4 is an enlarged perspective view of a basic alternate add on embodiment of a new Illuminated Fire Hose Rescue Nozzle according to the present invention.
Figure 5:
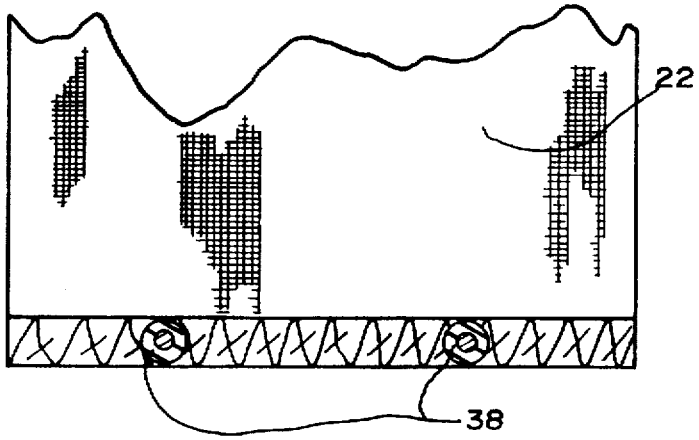
FIG. 5 is a cross sectional view taken along line 5—5 of FIG. 4.

Furthermore, it will be noted that a preferred add on alternate embodiment of the Illuminated Fire Hose Rescue Nozzle 60 comprises all of the above, except where the band 22 is preferably made of metal and is further defined as a variable sized band clamp and is illustrated in FIG. 8.

In use, the device is attached to a nozzle 4 of a fire hose 2 and when the on-off switch 14 is used to energize light 12, a pathway is illuminated in the direction the fire hose 2 is pointed.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, arc deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An illuminating fire hose rescue nozzle comprising: a nozzle for terminating a fire hose, an illuminating device having a light source enclosed within a housing, a mounting means for mounting said illuminating device to said nozzle such that light from said light source is directed in the direction that water exits the nozzle, and a power means for providing power to said illuminating device, where the mounting means is attached to the power means and to the illuminating device and where the mounting means additionally electrically connects the power means to the illumination device; and wherein the mounting means is further comprised of a band which is further defined as an elongated flexible strip having a first attachment means and a second attachment means disposed at each end of the band and wherein the first attachment means removably and matingly attaches to the second attachment means for securing the band in a fixed size about the nozzle, and wherein the band further includes a power transfer means which is fixedly and integratedly attached to the band and where the power transfer means and the band are fixedly attached and electrically connected to the power means and the illuminating device.

2. The illuminating fire hose rescue nozzle of claim 1, wherein the illuminating device is further comprised of a bulb, an on-off switch, a light reflection means, and a lens where the bulb is electrically connected to the on-off switch which in turn is electrically connected to the power means and where the light reflection means is fixedly fastened to the bulb and is positioned to direct emitted light in one general direction through the lens and where the lens is further defined as a protective transparent barrier which protects the bulb.

3. The illuminating fire hose rescue nozzle of claim 2, wherein the illuminating device further includes a light housing which is defined as an upright elongated cube having a lens aperture which threadedly receives the illuminating device reflection means and the lens and where the light is fixedly attached to and electrically connected to the mounting means.

4. The illuminated fire hose rescue nozzle of claim 3, wherein the power means is comprised of a power means housing where the power means housing matingly receives at least one battery which is electrically connected to the power transfer means.

5. The illuminated fire hose rescue nozzle of claim 4, wherein the power means housing is further defined as an elongated cylindrical shell which further includes an arcuate mounting surface, and an arcuate cover where the arcuate mounting surface is further defined as having a curve which protrudes into a body of the power means housing and is therefore a reverse or opposing curve to the curvature of the body of the power means housing and where the arcuate cover is pivotally attached to the power means housing by a cover hinge.

6. The illuminated fire hose rescue nozzle of claim 5, wherein the arcuate cover further includes a cover latch which retains the arcuate cover in a closed position and where the cover latch can be operated to open the arcuate cover in order to access the battery.

7. The illuminated fire hose rescue nozzle of claim 6, wherein the power means housing further includes a band aperture which matingly receives the band and allows the band to protrude through the power means housing and also therefore allows the power transfer means to be electrically connected to the battery.

8. An illuminated fire hose rescue nozzle comprising: a light, a mounting means adapted for mounting said light to a fire hose such that said light illuminates an area in the direction the fire hose points, and a power means for providing power to said light, where the mounting means is attached to the power means and to the light and where the mounting means additionally electrically connects the power means to the light:

wherein the light is further comprised of a bulb, an on-off switch, a light reflection means, and a lens where the bulb is electrically connected to the on-off switch which in turn is electrically connected to the power means and where the light reflection means is fixedly fastened to the bulb and is positioned to direct emitted light in one general direction through the lens and where the lens is further defined as a protective transparent barrier which protects the bulb;

wherein the light further includes a light housing which is defined as an upright elongated cube having a lens aperture which threadedly receives the light reflection means and the lens and where the light is fixedly attached to and electrically connected to the mounting means;

wherein the mounting means is further comprised of a band which is further defined as an elongated flexible strip of chemical and weather durable material having a first attachment means and a second attachment means disposed at each end of the band and where the first attachment means removably and matingly attaches to the second attachment means and where the band further includes a power transfer means which is fixedly and integratedly attached to the band and where the power transfer means and the band are fixedly attached and electrically connected to the power means and the light;

wherein the power means is comprised of a power means housing where the power means housing matingly receives at least one battery which is electrically connected to the power transfer means;

wherein the power means housing is further defined as an elongated cylindrical shell which further includes an arcuate mounting surface, and an arcuate cover where the arcuate mounting surface is further defined as having a curve which protrudes into a body of the power means housing and is therefore a reverse or opposing curve to the curvature of the body of the power means housing and where the arcuate cover is pivotally attached to the power means housing by a cover hinge;

wherein the arcuate cover further includes a cover latch which retains the arcuate cover in a closed position and where the cover latch can be operated to open the arcuate cover in order to access the battery;

wherein the power means housing further includes a band aperture which matingly receives the band and allows the band to protrude through the power means housing and also therefore allows the power transfer means to be electrically connected to the battery; and wherein the band aperture can slidingly receive the band to allow the power means housing to be located anywhere along a middle section of the band where the power transfer means has a sufficient length to accommodate a range of locations of said power means housing along said band while maintaining electrical connection with the battery.

9. The illuminated fire hose rescue nozzle of claim 8, wherein the power transfer means is further defined as at least one electrically conductive wire.

10. The illuminated fire hose rescue nozzle of claim 8, wherein the power transfer means is comprised of a two wire electrical conductor where one wire is electrically negative and the other wire is electrically positive.

11. The illuminated fire hose rescue nozzle of claim 9, wherein the power transfer means having at least one electrically conductive wire uses a nozzle of a fire hose to conduct electrically negative current and where the at least one electrically conductive wire conducts electrically positive current.

* * * * *